US007069999B2

(12) United States Patent
Hall et al.

(10) Patent No.: US 7,069,999 B2
(45) Date of Patent: Jul. 4, 2006

(54) APPARATUS AND METHOD FOR ROUTING A TRANSMISSION LINE THROUGH A DOWNHOLE TOOL

(75) Inventors: David R. Hall, Provo, UT (US); H. Tracy Hall, Jr., Provo, UT (US); David S. Pixton, Lehi, UT (US); Michael Briscoe, Lehi, UT (US); Jay Reynolds, West Provo, UT (US)

(73) Assignee: IntelliServ, Inc., Provo, UT (US)

( * ) Notice: Subject to any disclaimer, the term of this patent is extended or adjusted under 35 U.S.C. 154(b) by 184 days.

(21) Appl. No.: 10/708,129

(22) Filed: Feb. 10, 2004

(65) Prior Publication Data

US 2005/0173128 A1 Aug. 11, 2005

(51) Int. Cl.
*E21B 17/02* (2006.01)

(52) U.S. Cl. ..... 166/380; 166/65.1; 166/242.6

(58) Field of Classification Search ..... 166/380, 166/242.1, 242.6, 65.1; 138/108; 285/907
See application file for complete search history.

(56) References Cited

U.S. PATENT DOCUMENTS

| | | | | |
|---|---|---|---|---|
| 452,506 | A * | 5/1891 | Klumpp, Jr. | 340/320 |
| 749,633 | A | 1/1904 | Seeley | |
| 2,178,931 | A | 11/1939 | Crites et al. | |
| 2,197,392 | A | 4/1940 | Hawthorn | |
| 2,249,769 | A | 7/1941 | Leonardon | |
| 2,301,783 | A | 11/1942 | Lee | |
| 2,354,887 | A | 8/1944 | Silverman et al. | |
| 2,379,800 | A | 7/1945 | Hare | |
| 2,414,719 | A | 1/1947 | Cloud | |
| 2,531,120 | A | 11/1950 | Feaster | |
| 2,633,414 | A | 3/1953 | Boivinet | |
| 2,659,773 | A | 11/1953 | Barney | |
| 2,662,123 | A | 12/1953 | Koenig, Jr. | |
| 2,748,358 | A | 5/1956 | Johnston | |
| 2,974,303 | A | 3/1961 | Dixon | |
| 2,982,360 | A | 5/1961 | Morton et al. | |
| 3,079,549 | A | 2/1963 | Martin | |
| 3,090,031 | A | 5/1963 | Lord | |
| 3,170,137 | A | 2/1965 | Brandt | |
| 3,186,222 | A | 6/1965 | Martin | |
| 3,194,886 | A | 7/1965 | Mason | |
| 3,209,323 | A | 9/1965 | Grossman, Jr. | |
| 3,227,973 | A | 1/1966 | Gray | |
| 3,253,245 | A | 5/1966 | Brandt | |
| 3,518,608 | A | 6/1970 | Papadopoulos | |

(Continued)

FOREIGN PATENT DOCUMENTS

| | | | |
|---|---|---|---|
| EP | 0399987 | A1 | 11/1990 |

(Continued)

*Primary Examiner*—Kenneth Thompson
(74) *Attorney, Agent, or Firm*—Jeffery E. Daly; Tyson J. Wilde

(57) ABSTRACT

A method for routing a transmission line through a tool joint having a primary and secondary shoulder, a central bore, and a longitudinal axis, includes drilling a straight channel, at a positive, nominal angle with respect to the longitudinal axis, through the tool joint from the secondary shoulder to a point proximate the inside wall of the centtral bore. The method further includes milling back, from within the central bore, a second channel to merge with the straight channel, thereby forming a continuous channel from the secondary shoulder to the central bore. In selected embodiments, drilling is accomplished by gun-drilling the straight channel. In other embodiments, the method includes tilting the tool joint before drilling to produce the positive, nominal angle. In selected embodiments, the positive, nominal angle is less than or equal to 15 degrees.

34 Claims, 11 Drawing Sheets

U.S. PATENT DOCUMENTS 3,696,332 A 10/1972 Dickson, Jr. et al.
3,793,632 A 2/1974 Still
3,807,502 A 4/1974 Heilhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,227,682 A * 10/1980 Ulveling et al. ..... 266/271
4,348,672 A 9/1982 Givler
4,367,797 A * 1/1983 Brown ..... 166/380
4,445,734 A 5/1984 Cunningham
4,496,203 A 1/1985 Meadows
4,537,457 A 8/1985 Davis, Jr. et al.
4,578,675 A 3/1986 Macleod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schnock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,209,632 B1 4/2001 Holbert et al.
6,223,826 B1 5/2001 Chau et al.
6,367,564 B1 * 4/2002 Mills et al. ..... 175/40
6,367,565 B1 4/2002 Hall
6,392,317 B1 5/2002 Hall et al.
6,405,795 B1 6/2002 Holbert et al.
6,641,434 B1 11/2003 Boyle et al.
6,655,464 B1 12/2003 Chau et al.
6,670,880 B1 12/2003 Hall et al.
6,688,396 B1 * 2/2004 Floerke et al. ..... 166/380
2002/0135179 A1 9/2002 Boyle et al.
2002/0193004 A1 12/2002 Boyle et al.
2003/0070842 A1 4/2003 Bailey et al.
2003/0213598 A1 11/2003 Hughes

FOREIGN PATENT DOCUMENTS

WO W8801096 2/1988
WO WO9014497 11/1990

* cited by examiner

APPARATUS AND METHOD FOR ROUTING A TRANSMISSION LINE THROUGH A DOWNHOLE TOOL

FEDERAL RESEARCH STATEMENT

This invention was made with government support under Contract No. DE-FC26 01NT41229 awarded by the U.S. Department of Energy. The government has certain rights in the invention.

BACKGROUND OF INVENTION

1. Field of the Invention

This invention relates to oil and gas drilling, and more particularly to apparatus and methods for reliably transmitting information along downhole drilling strings.

2. Background of the Invention

In the downhole drilling industry, MWD and LWD tools are used to take measurements and gather information with respect to downhole geological formations, status of downhole tools, conditions located downhole, and the like. Such data is useful to drill operators, geologists, engineers, and other personnel located at the surface. This data may be used to adjust drilling parameters, such as drilling direction, penetration speed, and the like, to accurately tap into oil, gas, or other mineral bearing reservoirs. Data may be gathered at various points along the drill string. For example, sensors, tools, and the like, may be located at or near the bottom hole assembly and on intermediate tools located at desired points along the drill string.

Nevertheless, data gathering and analysis do not represent the entire process. Once gathered, apparatus and methods are needed to rapidly and reliably transmit the data to the earth's surface. Traditionally, technologies such as mud pulse telemetry have been used to transmit data to the surface. However, most traditional methods are limited to very slow data rates and are inadequate for transmitting large quantities of data at high speeds.

In order to overcome these limitations, various efforts have been made to transmit data along electrical or other types of cable integrated directly into drill string components, such as sections of drill pipe. In such systems, electrical contacts or other transmission elements are used to transmit data across tool joints or connection points in the drill string. Nevertheless, many of these efforts have been largely abandoned or frustrated due to unreliability and complexity.

For example, one challenge is effectively integrating a transmission line into a downhole tool, such as a section of drill pipe. Due to the inherent nature of drilling, most downhole tools have a similar cylindrical shape defining a central bore. The wall thickness surrounding the central bore is typically designed in accordance with weight, strength, and other constraints imposed by the downhole environment. In some cases, milling or forming a channel in the wall of a downhole tool to accommodate a transmission line may critically weaken the wall. Thus, in certain embodiments, the only practical route for a transmission line is through the central bore of the downhole tool.

At or near the box end and pin end of the downhole tool, a transmission line may be routed from the central bore through the tool wall. This may be done for several reasons. First, the box end and pin end are typically constructed with thicker walls to provide additional strength at the tool joints. This added thickness is many times sufficient to accommodate a channel without critically weakening the wall. Second, transmission elements are typically installed in the box end and pin end to transmit information across the tool joints. These transmission elements are typically embedded within recesses formed in the box end and pin end. Thus, channels are needed in the box end and pin end to provide a path for the transmission line between the transmission elements and the central bore of the downhole tool.

Thus, what are needed are apparatus and methods for installing channels in the box end and pin end of downhole tools to provide routes for transmission lines traveling between transmission elements and the central bore.

What are further needed are improved apparatus and methods for providing a smooth path for a transmission line routed through a downhole tool to prevent kinking or other damage.

What are further needed are improved apparatus and methods for effectively drilling or otherwise forming channels in the box end and pin end of a downhole tool.

Finally, what are needed are apparatus and methods to minimize the expense and labor required to install these channels in the box end and pin end of a downhole tool.

SUMMARY OF INVENTION

In view of the foregoing, it is a primary object of the present invention to provide apparatus and methods for installing paths or channels in the box end and pin end of a downhole tool to provide a route for a transmission line traveling between transmission elements and the central bore. It is a further object to provide improved apparatus and methods for smoothing the path or route of a transmission line to prevent kinking or other damage to a transmission line routed through a downhole tool. It is yet a further object to provide improved apparatus and methods for effectively drilling or forming channels in the box end and pin end of a downhole tool. Finally, it is a further object to minimize the expense and labor required to form these channels in the box end and pin end of a downhole tool.

Consistent with the foregoing objects, and in accordance with the invention as embodied and broadly described herein, a method for routing a transmission line through a tool joint having a primary and secondary shoulder, a central bore, and a longitudinal axis, is disclosed in one embodiment of the invention as including drilling a straight channel, at a positive, nominal angle with respect to the longitudinal axis, through the tool joint from the secondary shoulder to a point proximate the inside wall of the central bore. The method further includes milling back, from within the central bore, a second channel to merge with the straight channel, thereby forming a continuous channel from the secondary shoulder to the central bore.

In selected embodiments, drilling includes gun-drilling the straight channel. In other embodiments, the method includes tilting the tool joint before drilling to produce the positive, nominal angle. In selected embodiments, tilting includes adjusting the tilt before drilling to provide a desired positive, nominal angle. In selected embodiments, the positive, nominal angle is less than or equal to 15 degrees.

In certain embodiments, the straight channel does not break into the central bore. In other embodiments, the straight channel breaks into the central bore at a non-perpendicular angle. In such embodiments, a backing member may be inserted into the central bore to facilitate drilling into the central bore at the non-perpendicular angle. In other embodiments, milling back includes milling the second channel with a milling tool inserted into the central bore. This milling process may be used to open the straight channel to the central bore.

In another aspect of the invention, an apparatus in accordance with the invention includes a tool joint of a downhole tool, wherein the tool joint includes a primary and secondary shoulder, a central bore, and a longitudinal axis. The apparatus further includes a gun-drilled channel formed in the tool joint from the secondary shoulder to a point proximate the central bore, and an open channel milled from the central bore to the gun-drilled channel, such that the gun-drilled channel and the open channel merge to form a continuous channel.

In selected embodiments, the gun-drilled channel is drilled at a positive, nominal angle with respect to the longitudinal axis. In some cases, this positive, nominal angle is less than or equal to 15 degrees. In selected embodiments, the gun-drilled channel does not break into the central bore. In other embodiments, the gun-drilled channel breaks into the central bore at a non-perpendicular angle. In yet other embodiments, the gun-drilled channel breaks into the central bore substantially perpendicularly. In some cases, the open channel is milled with a milling tool inserted into the central bore.

In another aspect of the invention, a method for routing a transmission line through a tool joint of a downhole tool, wherein the tool joint includes primary and secondary shoulders, a tool wall, a central bore, and a longitudinal axis, includes increasing the inside diameter of a portion of the central bore to provide a first portion having a standard diameter, and a second portion having an enlarged diameter. The method further includes drilling a channel through the tool wall from the secondary shoulder to an exit point within the second portion.

In selected embodiments, drilling includes gun-drilling that may or may not break into the central bore. In other embodiments, drilling includes milling back from the central bore to the gun-drilled channel. In certain cases, this milling process opens up the channel to the central bore. In selected embodiments, the channel breaks into the central bore at a non-perpendicular angle. In such cases, a backing member may be inserted into the central bore to facilitate drilling into the central bore at a non-perpendicular angle. In other embodiments, the channel breaks into the central bore at a substantially perpendicular angle.

In another aspect of the invention, a method for routing a transmission line through a downhole tool having primary and secondary shoulders, a central bore, and a longitudinal axis, includes drilling a straight channel through the downhole tool from the secondary shoulder to a point proximate the inside wall of the central bore. The method further includes milling back, from within the central bore, a second channel effective to merge with the straight channel, to form a continuous channel from the secondary shoulder to the central bore.

In yet another aspect of the invention, a method for routing a transmission line through a tool joint having primary and secondary shoulders, a central bore, and a longitudinal axis, includes drilling a straight channel, at a positive, nominal angle with respect to the longitudinal axis, through the tool joint from the secondary shoulder to the central bore.

BRIEF DESCRIPTION OF DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings.

DETAILED DESCRIPTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
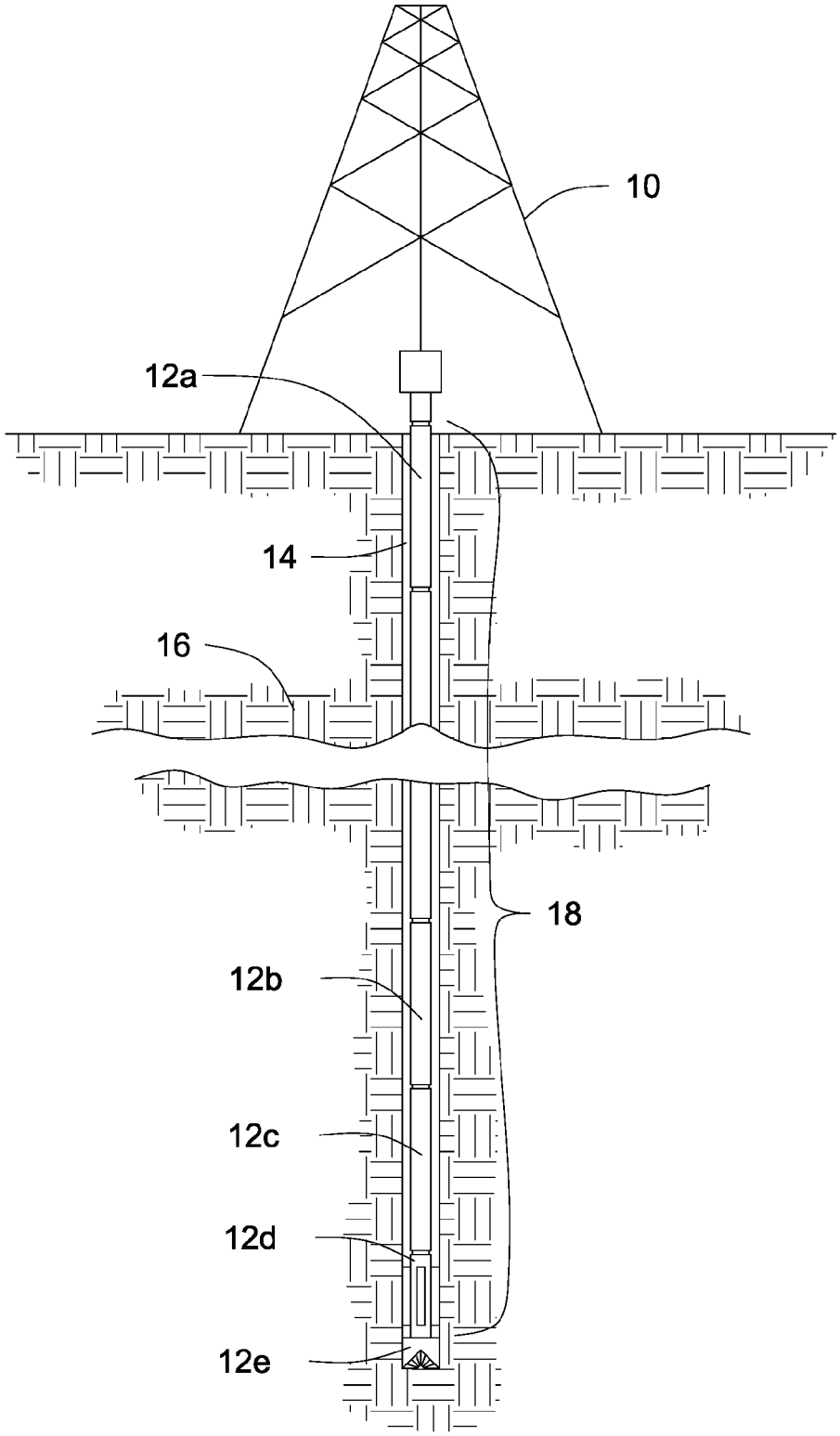
FIG. 1 is a cross-sectional view illustrating one embodiment of a drill rig in accordance with the invention.

Referring to FIG. 1, a cross-sectional view of a drill rig 10 is illustrated drilling a borehole 14 into the earth 16 using downhole tools (collectively indicated by numeral 12). The collection of downhole tools 12 form at least a portion of a drill string 18. In operation, a drilling fluid is typically supplied under pressure at the drill rig 10 through the drill string 18. The drill string 18 is typically rotated by the drill rig 10 to turn a drill bit 12*e* which is loaded against the earth 16 to form the borehole 14.

Pressurized drilling fluid is circulated through the drill bit 12*e* to provide a flushing action to carry the drilled earth cuttings to the surface. Rotation of the drill bit may alternately be provided by other downhole tools such as drill motors, or drill turbines (not shown) located adjacent to the drill bit 12*e*. Other downhole tools include drill pipe 12*a* and downhole instrumentation such as logging while drilling tools 12*c*, and sensor packages (not shown). Other useful downhole tools include stabilizers 12*d*, hole openers, drill collars, heavyweight drill pipe, sub-assemblies, under-reamers, rotary steerable systems, drilling jars, and drilling shock absorbers, which are all well known in the drilling industry.

Figure 2:
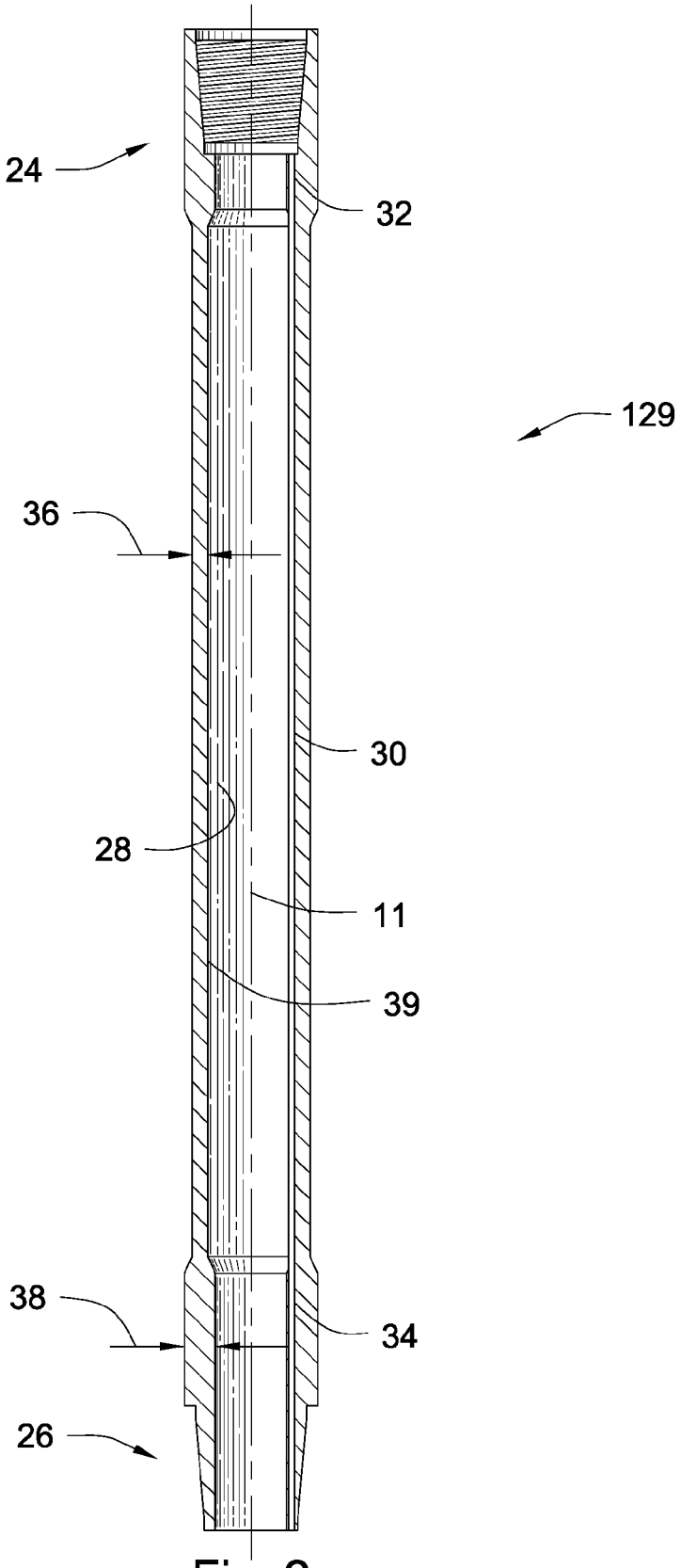
FIG. 2 is a cross-sectional view illustrating one embodiment of a transmission line integrated into a downhole tool, such as a section of drill pipe.

Referring to FIG. 2, a downhole tool 12*a* may include a box end 24 and a pin end 26. A pin end 26 may thread into a box end 24, thereby enabling the connection of multiple tools 12 together to form a drill string 18. Due to the inherent nature of drilling, most downhole tools 12*a* have a similar cylindrical shape and a central bore 28. The central bore 28 is used to transport drilling fluids, wireline tools, cement, and the like through the drill string 18.

The wall thickness 36 surrounding the central bore 28 is typically designed in accordance with weight, strength, and other constraints, needed to withstand substantial torque placed on the tool 12*a*, pressure within the central bore 28, flex in the tool 12*a*, and the like. Because of the immense forces placed on the tool 12*a*, milling or forming a channel in the wall 36 of the downhole tool 12*a* to accommodate a transmission line 30 may excessively weaken the wall. Thus, in most cases, the only practical route for a transmission line 30 is through the central bore 28 of the downhole tool 12*a*.

Nevertheless, routing the transmission line 30 through the central bore 28 may expose the transmission line 30 to drilling fluids, cements, wireline tools, or other substances or objects passing through the central bore 28. This can damage the transmission line 30 or create interference between the transmission line 30 and objects or substances passing through the central bore 28. Thus, in selected embodiments, a transmission line 30 is preferably maintained as close to the wall 36 of the central bore 28 as possible to minimize interference. In selected embodiments, the transmission line 30 is protected by a conduit 30 or other protective covering 30 to protect the internal transmission medium (e.g. wire, fiber, etc.).

As illustrated, at or near the box end 24 and pin end 26 of the tool 12*a*, the central bore 28 may be narrower and the surrounding tool wall 38 may be thicker. This increases the strength of the downhole tool 12*a* at or near the tool joints, which undergo a great deal of stress during drilling. In addition, the added thickness 38 may enable channels 32, 34, to be milled or formed in the walls 38 to accommodate a transmission line 30 without critically weakening the tool 12*a*. The channels 32, 34 may exit the downhole tool 12*a* at or near the ends of the tool 12*a*, where the transmission line 30 may be coupled to transmission elements (not shown) to transmit information across the tool joints.

Figure 3:
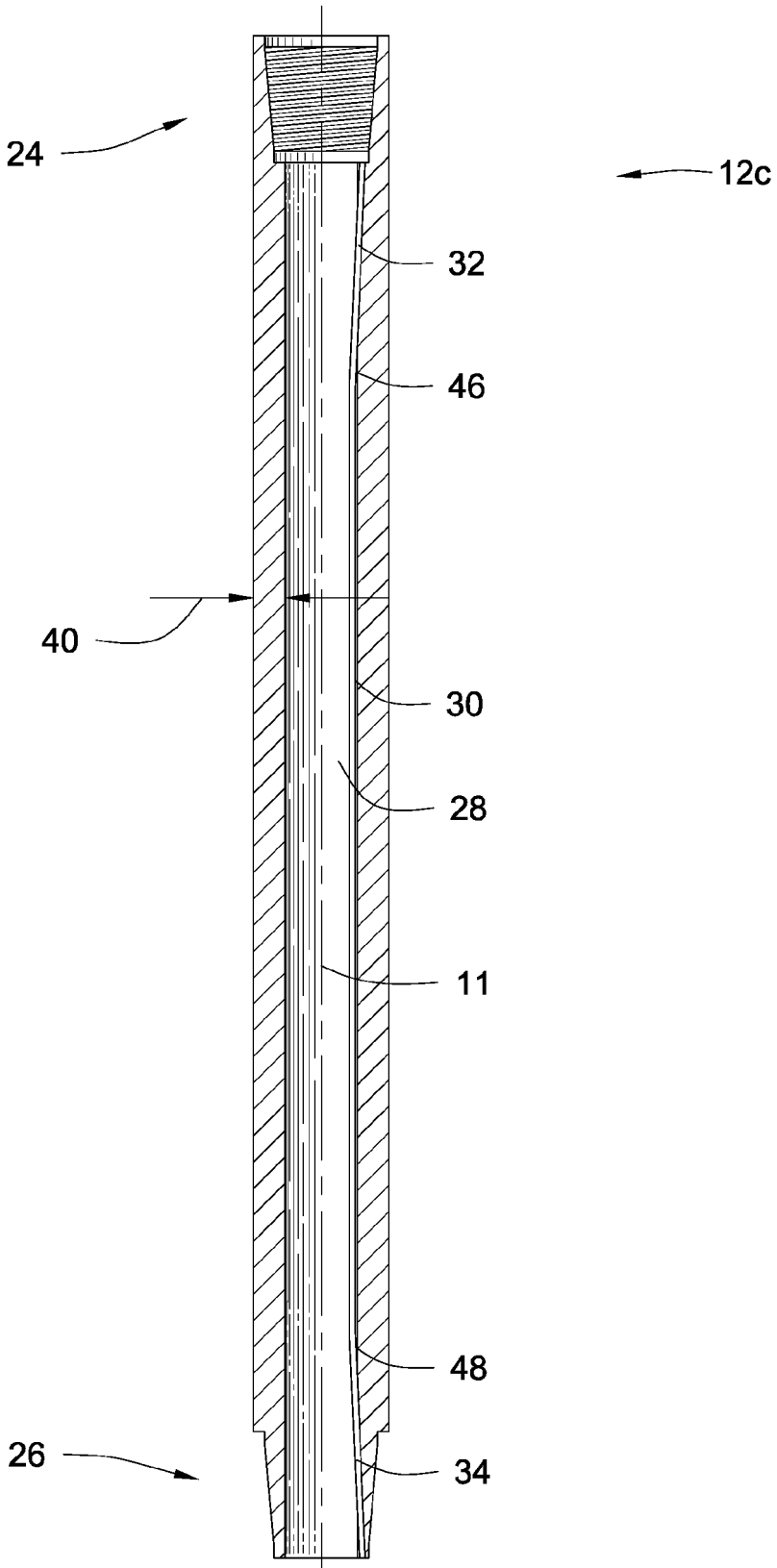
FIG. 3 is a cross-sectional view illustrating one embodiment of a transmission line integrated into a heavyweight downhole tool, such as a section of heavyweight drill pipe.

Referring to FIG. 3, in contrast to the downhole tool 12*a* illustrated in FIG. 2, certain downhole tools 12*c* may be characterized by a tool wall 40 of greater thickness. For example, at or near the bottom hole assembly 12*e*, a drill string 18 may include various heavyweight tools 12*c*, such as heavyweight drill pipe 12*c* or sections of drill collar 12*c*. Such tools 12*c* may have a central bore 28 having a substantially constant inside diameter between the box end 24 and the pin end 26. Due to the substantially constant diameter of the central bore 28, a distinct solution is needed to route a transmission line 30 through the downhole tool 12*c*. For example, in selected embodiments, as illustrated, a transmission line 30 may be routed such that it bends or angles away from the longitudinal axis 11 of the tool 12*c* at or near the box and pin ends 24, 26. The transmission line 30 travels through the central bore 28 along the central portion of the tool 28. At or near the box end 24 and pin end 26, the transmission line 30 is routed into channels 32, 34 to connect to transmission elements (not shown). Because of the unique configuration of the downhole tool 12*c*, novel apparatus and methods are needed to create the channels 32, 34 and route the transmission line 30 in a manner that avoids kinking or other damage to the transmission line 30.

Figure 4A:
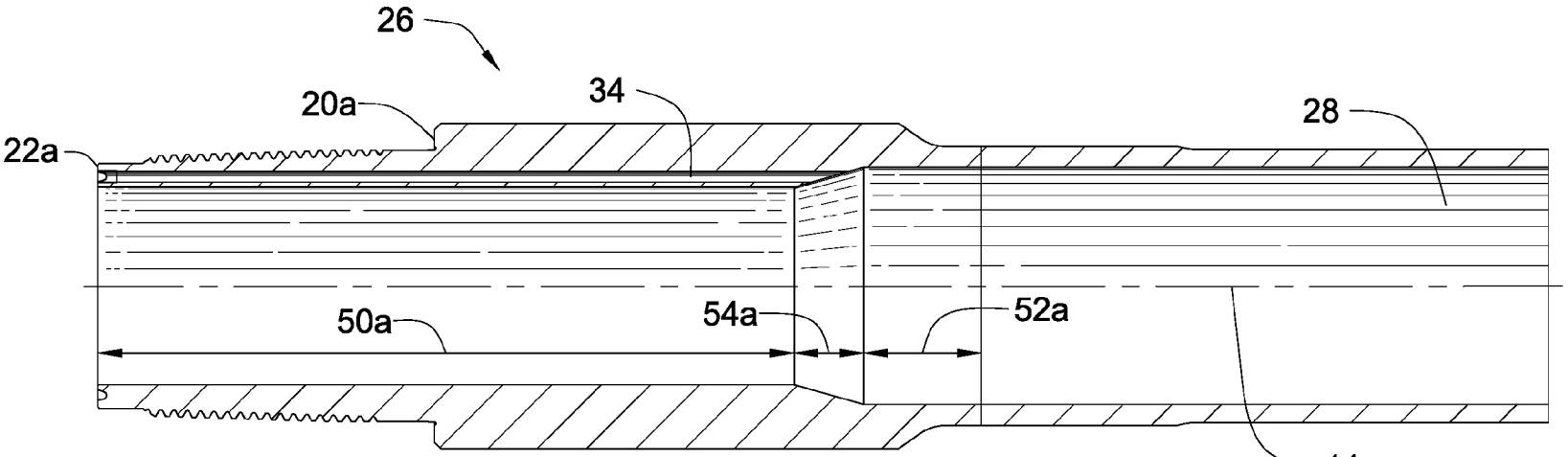
FIGS. 4A and 4B are two cross-sectional views illustrating the box end and pin end of a section of drill pipe, wherein part of the central bore is enlarged to provide a shorter path for a transmission line through the tool joint.
Figure 4B:
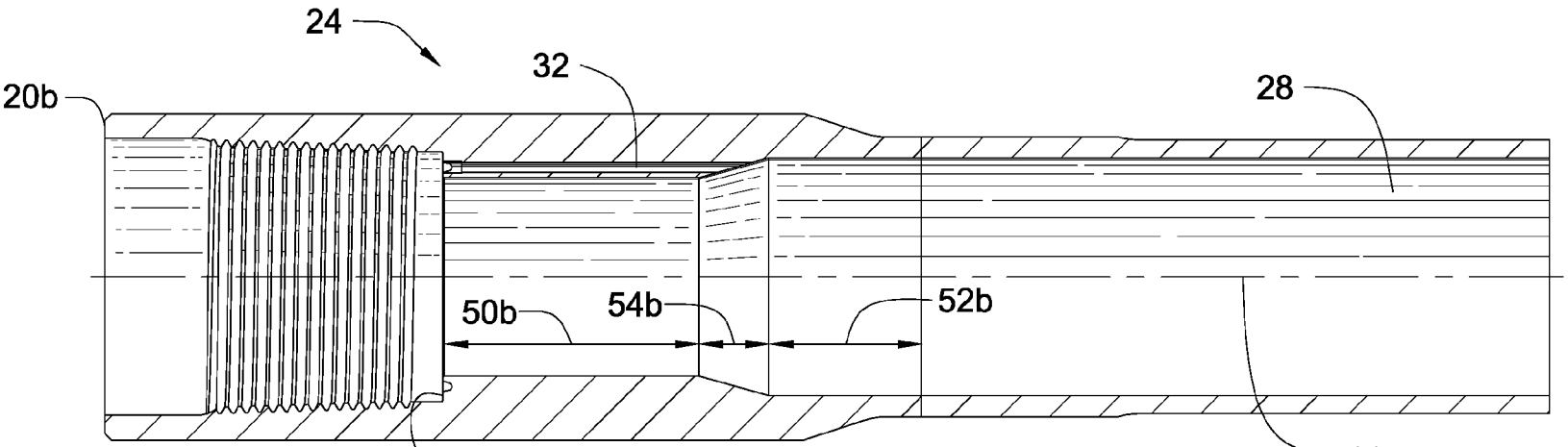

Referring to FIGS. 4A and 4B, in drill tools 12*a* like that described with respect to FIG. 2, a transmission line 30 may travel through channels 32, 34 formed in the box end 24 and pin end 26 of a downhole tool 12*a*. As illustrated, the box end 24 and pin end 26 may include primary shoulders 20*a*, 20*b* and secondary shoulders 22*a*, 22*b*. In operation, the primary shoulders 20*a*, 20*b* may absorb the majority of the stress imposed on the tool joint. Nevertheless, the secondary shoulders 22*a*, 22*b* may also absorb a significant, although lesser, amount of stress. Because of the lower stress, and also because the secondary shoulders 22*a*, 22*b* are more internally protected than the primary shoulders 20*a*, 20*b*, transmission elements may be located on the secondary shoulders 22*a*, 22*b*.

In selected embodiments, it may be desirable to shorten the channels 32, 34 between the transmission elements and the central bore 28 as much as possible to conserve the time and expense of creating the channels 32, 34. For example, in some downhole tools 12*a*, the channels 32, 34 may be formed by gun-drilling the box end 24 and pin end 26. Normally, a box end 24 or pin end 26 is characterized by a restricted bore 50*a*, 50*b* having a narrower diameter, and an expanded bore 52*a*, 52*b* having a larger diameter. The expanded bore 52*a*, 52*b* is typically sized to mate with and roughly equal the diameter of the central bore 28 of the drill tool 12*a*. Between the restricted bore 50 and the expanded bore 52 is typically a transition region 54*a*, 54*b* where the restricted bore 50 transitions to the expanded bore 52. To prevent tools, drilling fluids, or other substances from lodging themselves within the central bore 28, the transition region 54 is typically configured to provide a smooth or graded transition between the restricted bore 50 and the expanded bore 52.

In selected embodiments, the channels 32, 34 may be formed in the box end 24 and pin end 26 through the tool wall surrounding the restricted bore 50*a*, 50*b*. When the channels 32, 34 reach the transition regions 54*a*, 54*b*, the channels break through the tool wall into the expanded bore 52*a*, 52*b*. Because the length of the restricted bore 50*a*, 50*b* is roughly proportional to the length of the channels 32, 34 traveling though the tool wall, the channels 32, 34 may be shortened by shortening the restricted bore 50 and lengthening the expanded bore 52. This provides a desired effect since the process of gun-drilling may be costly and timeconsuming. Thus, apparatus and methods are needed to reduce or shorten the channels 32, 34.

Figure 5A:
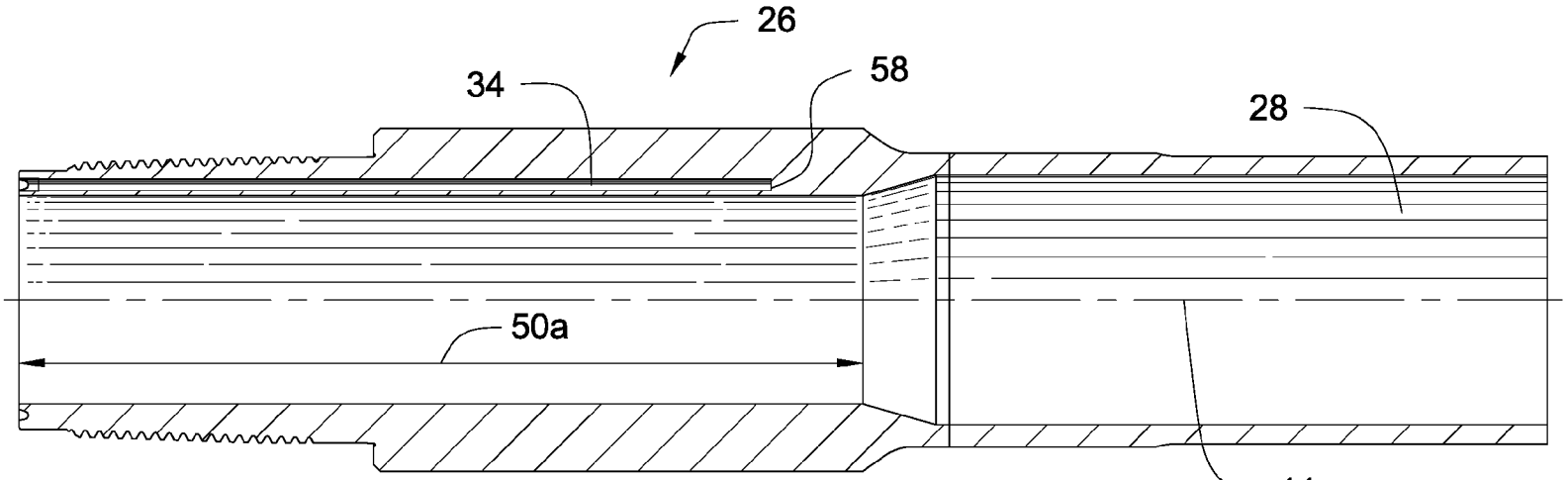
FIGS. 5A and 5B are two cross-sectional views of the box end and pin end of a section of drill pipe, wherein channels are only partially drilled through the tool wall.
Figure 5B:
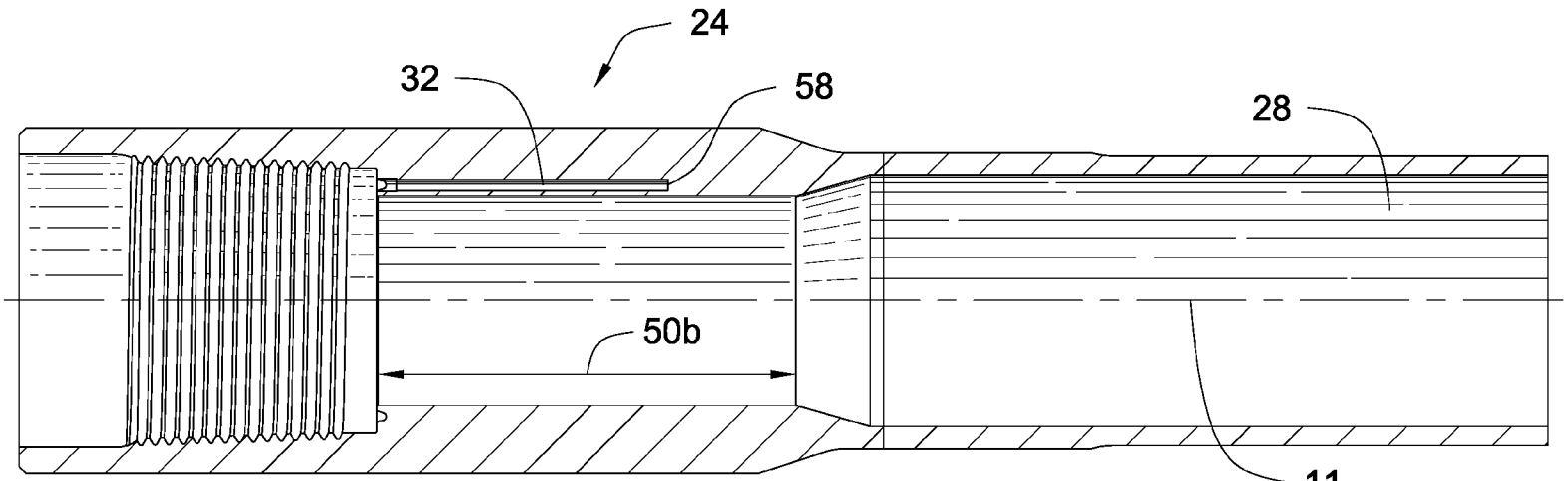

Referring to FIGS. 5A and 5B, for example, in selected embodiments, the restricted bore 50 may extend a specified distance through the box end 24 and pin end 26. The channels 32, 34 may be drilled through only a portion of the tool wall, but not actually exit into the central bore 28.

Figure 6A:
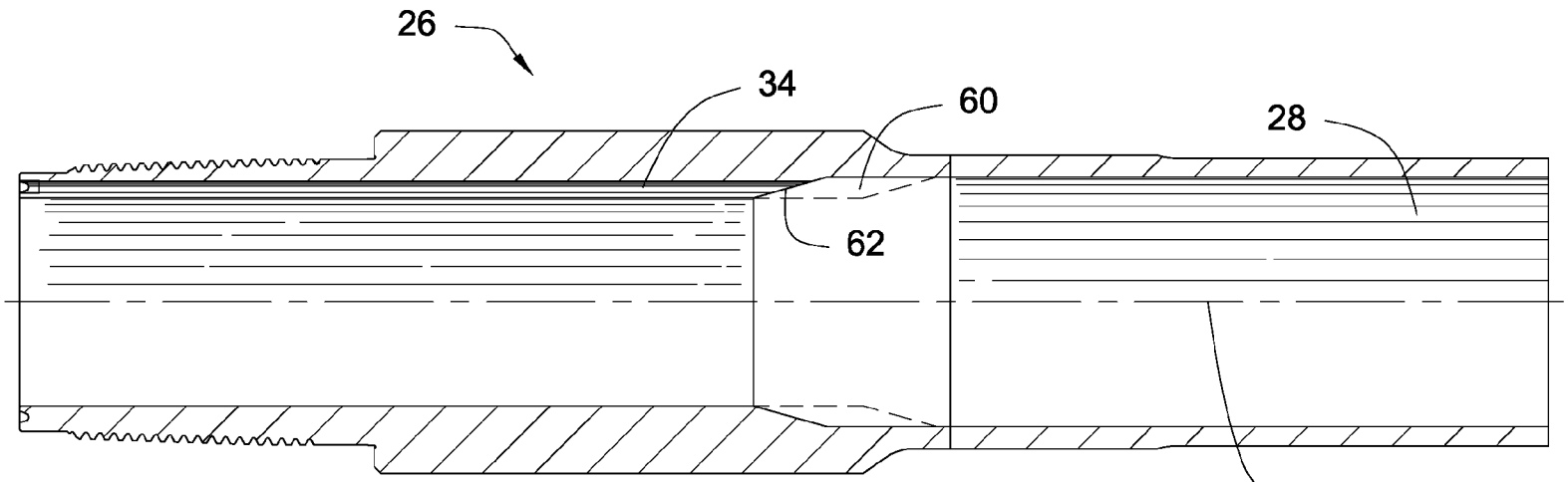
FIGS. 6A and 6B are two cross-sectional views of the box end and pin end illustrated in FIGS. 5A and 5B, wherein part of the central bore is enlarged to expose the channels to the central bore.
Figure 6B:
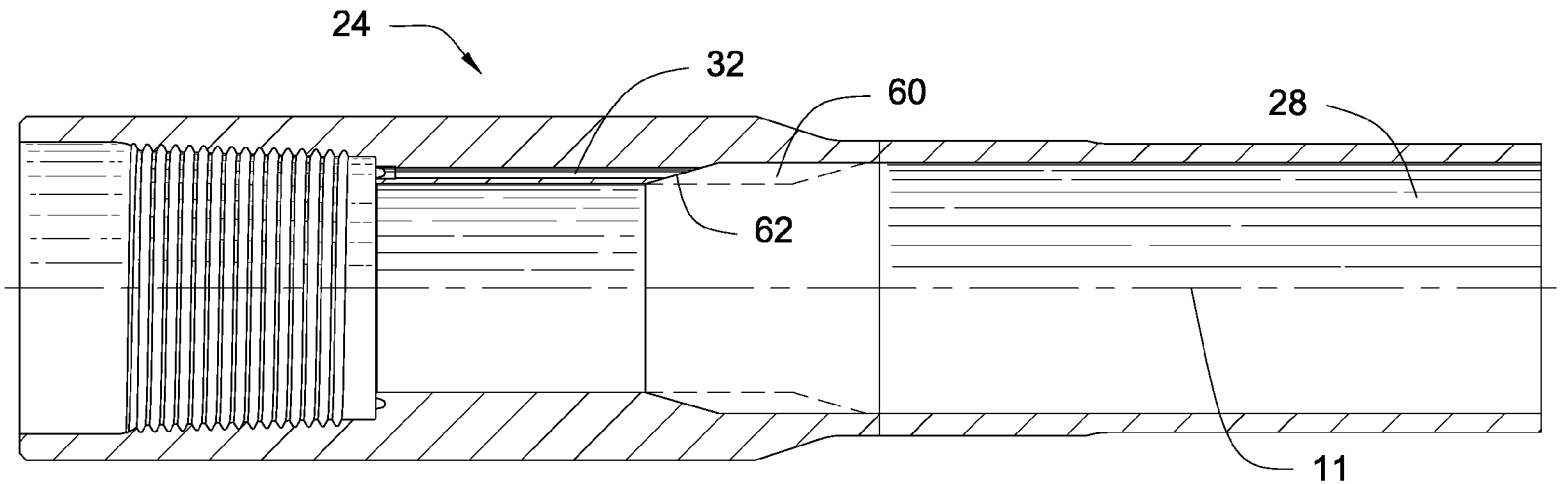

Referring to FIGS. 6A and 6B, once the channels 32, 34 are drilled or formed, portions of the tool wall 60 may be removed by counter-boring the restricted bore 50, thereby exposing the channels 32, 34 to the central bore 28. Thus, the length of the channels 32, 34 and the distance drilled may be reduced. In other embodiments, the restricted bore 50 may be shortened before drilling the channels 32, 34. In yet other embodiments, the box end 24, the pin end 26, or both, may be redesigned to have a restricted bore 50 of a reduced length, thereby reducing the distance needed to drill the channels 32, 34. In selected embodiments, a drill bit, such as may be used for gun-drilling, may be damaged if it breaks into the central bore, or if it breaks into the central bore at a non-perpendicular angle. In such cases, a backing plate (not shown) or other material may be inserted into the central bore when drilling the channels 32, 34. This may prevent the drill bit from breaking out of the tool wall into the central bore 28.

Figure 7A:
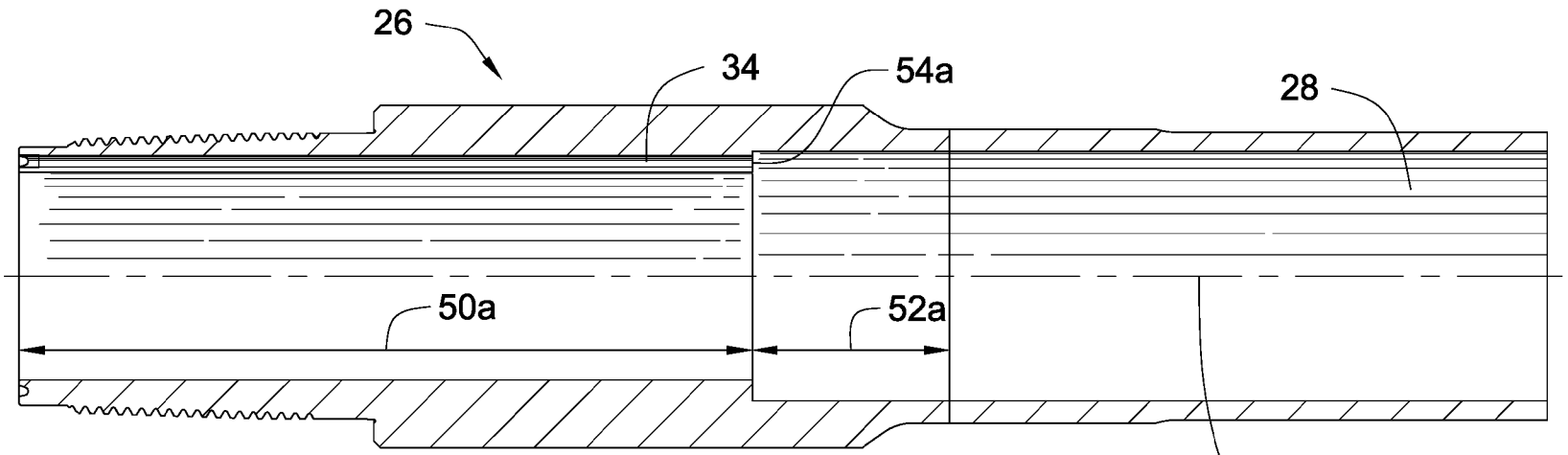
FIGS. 7A and 7B are two cross-sectional views of the box end and pin end of a section of drill pipe, wherein channels exit perpendicularly into the central bore.
Figure 7B:
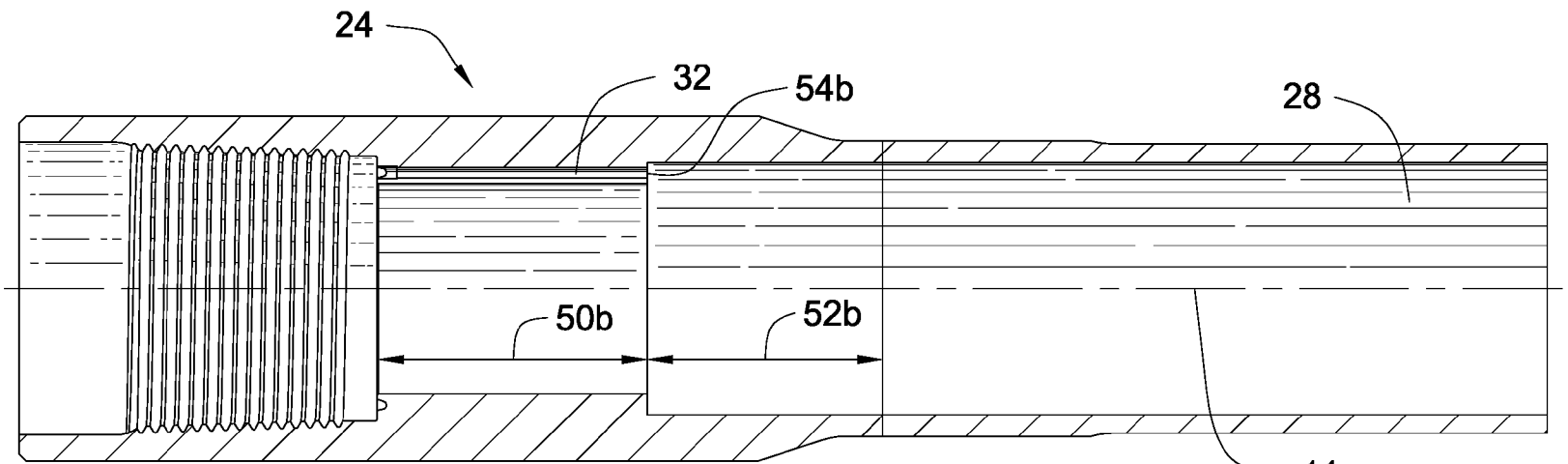

Referring to FIGS. 7A and 7B, in another embodiment, a box end 24 and pin end 26 may be designed such that the channels 32, 34 break into the enlarged bore 52 at a right angle. This may be accomplished by making the transition regions 54*a*, 54*b* substantially perpendicular to the longitudinal axis 11 of the downhole tool 12. Thus, in some embodiments, a drill bit, such as a drill bit used for gun-drilling, may break into the enlarged bore at a right angle, thereby preventing damage to the bit. Nevertheless, this configuration may be undesirable in some applications, since the transition regions 54*a*, 54*b* may hinder the passage of tools or other substances passing through the central bore 28 of a downhole tool 12.

Figure 8A:
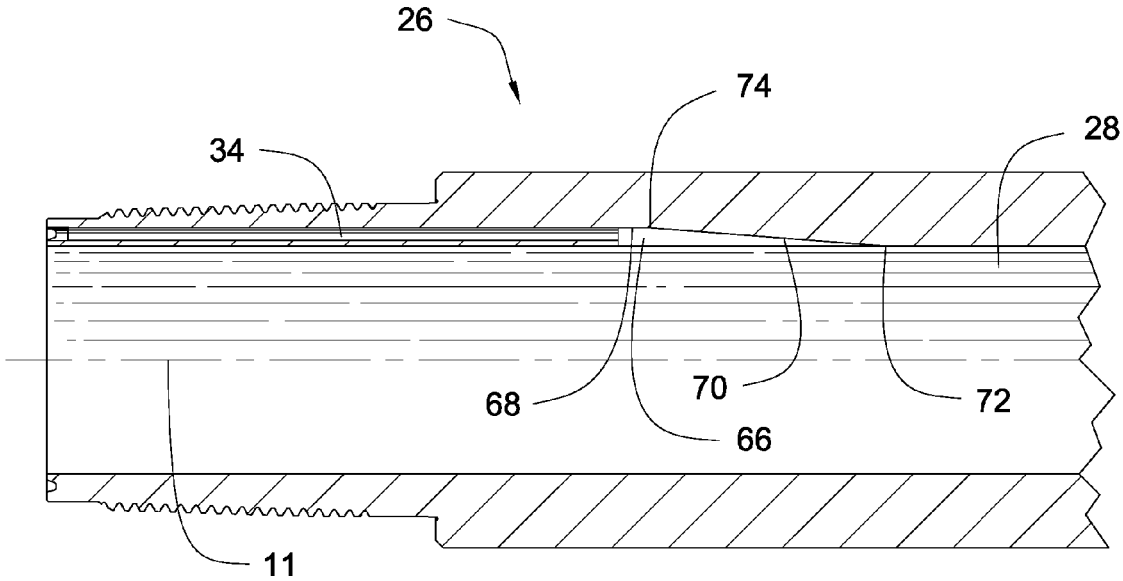
FIGS. 8A and 8B are two cross-sectional views of the box end and pin end of a section of heavyweight drill pipe, wherein channels are drilled into the tool joints and are exposed to the central bore by milling channels into the tool wall from within the central bore.
Figure 8B:
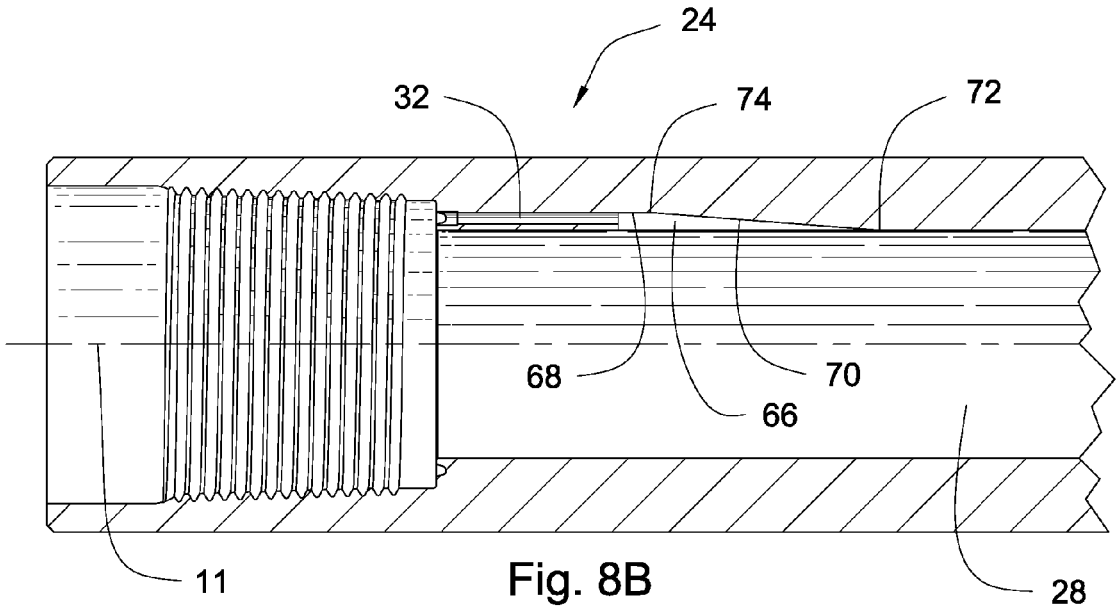

Referring to FIGS. 8A and 8B, in applications where the central bore 28 is relatively constant, such as may be found in heavyweight drill pipe or drill collar, channels 32, 34 are needed to route a transmission line through such tools. Nevertheless, because of the constant or near constant bore 28 of the tool, other methods are needed to provide a route for a transmission line. For example, in contrast to the drill tool illustrated in FIGS. 4A and 4B, the drill tool illustrated in FIGS. 8A and 8B lacks a transition region 54*a*, 54*b* where the channels 32, 34 can exit into the central bore 28.

In selected embodiments, channels 32, 34 may be initially drilled in the tool wall of the box end 24 and pin end 26. The channels 32, 34 may be drilled such that they do not exit or break into the central bore 28, thereby preventing damage to the drill bit. In selected embodiments, the channels 32, 34 may be drilled substantially parallel to the longitudinal axis 11 of the downhole tool 12. Once the channels 32, 34 are drilled, open channels 66 may be milled into the inside wall of the central bore 28 to open up the channels 32, 34 to the central bore 28.

In selected embodiments, the open channels 66 may be shaped to provide a smooth transition for a transmission line routed between the channels 32, 34 and the central bore 28. For example, the open channels 66 may include a first surface 68 substantially parallel to the channels 32, 34, and a curve 74 or bend 74 to guide the transmission line towards the central bore 28. Likewise, a second bend 74 or curve 74 may enable a transmission line to gently bend from the open channel 66 to a position along the inside wall of the central bore 28. Thus, the open channel 66 may be shaped, as needed, to prevent kinking or other damage to a transmission line.

Figure 9A:
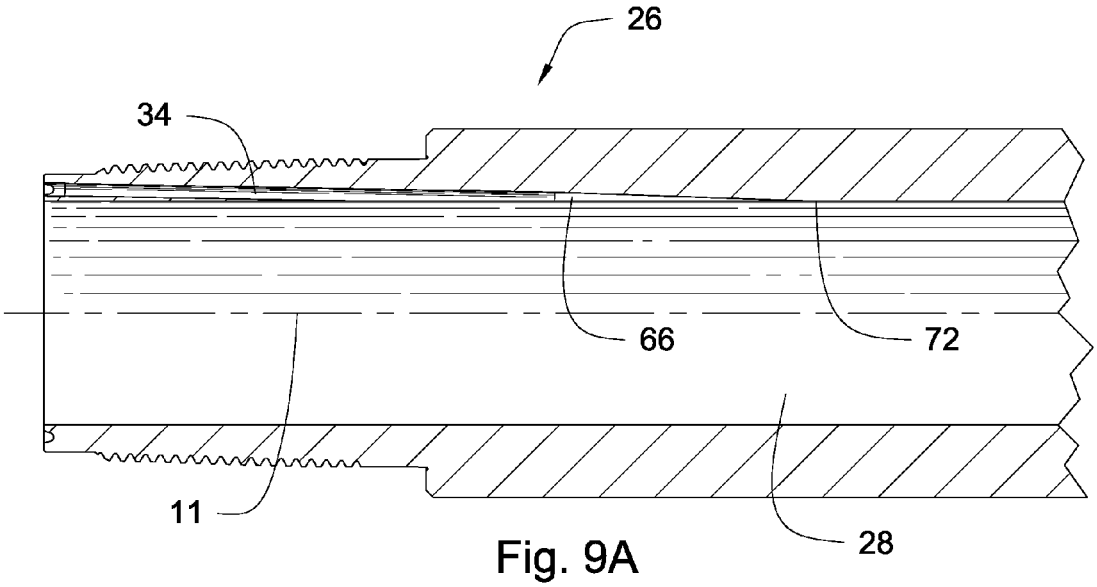
FIGS. 9A and 9B are two cross-sectional views of the box end and pin end of a section of heavyweight drill pipe, wherein channels are drilled into the tool joints at a positive, nominal angle with respect to the longitudinal axis of the tool joint, and are exposed to the central bore by milling channels into the tool wall from within the central bore.
Figure 9B:
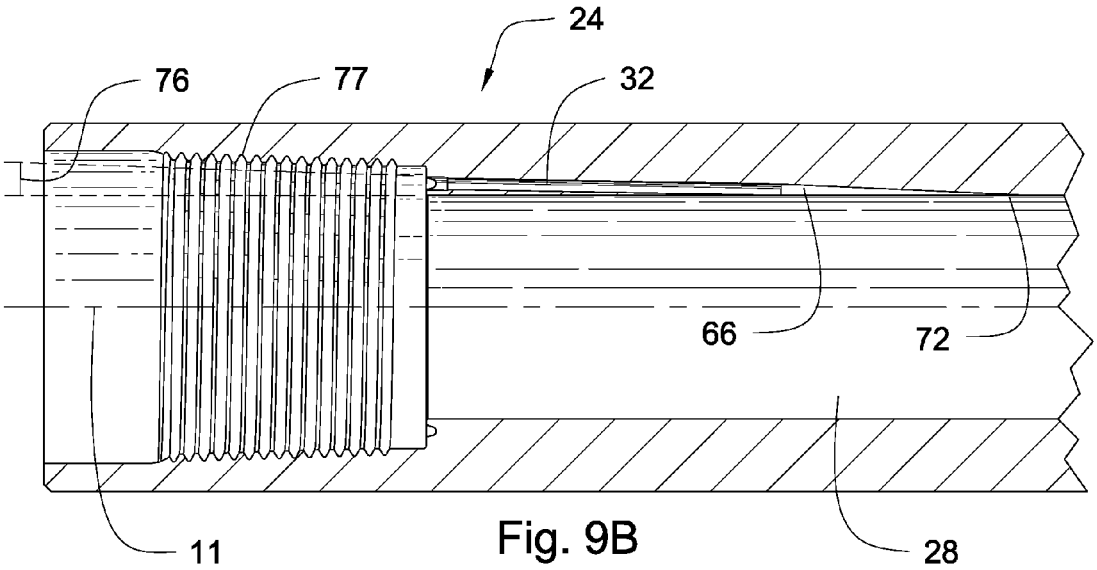

Referring to FIGS. 9A and 9B, in another embodiment, channels 32, 34 may be drilled at a nominal angle 76 with respect to and toward, the longitudinal axis 11 of the downhole tool from the secondary shoulder towards the central bore 28. The angle 76 is a positive, nominal angle with respect to the longitudinal axis 11, but is by design greater than a "zero" degree angle, which may be canted slightly due to variations caused by hole tolerances. The angle 76 may be limited by the geometry of the box end 24 and pin end 26 in some cases, but is generally oriented greater than about 0.25 degrees in a positive direction, toward the longitudinal axis 11. For example, the angle 76 may be limited by the angle of the threaded portion of the box end 24. In some cases, the angle 76 of the channels 32, 34 may form an angle of less than or equal to 15 degrees with respect to the longitudinal axis 11 of the downhole tool. In a preferred embodiment, the positive angle 76 is between about 0.25 degrees and about 15 degrees.

In selected embodiments, the channels 32, 34 may be drilled such that they do not actually break into the central bore 28 to prevent damage to the drill bit. Once the channels 32, 34 are drilled, a milling tool (not shown) may be inserted into the central bore 28 to open up the channels 32, 34 to the central bore 28. For example, open channels 66 may be milled in the wall of the central bore 28 to open up the channels 32, 34 and to provide a smooth transition for a transmission line routed from the channels 32, 34 to the central bore 28.

Figure 10:
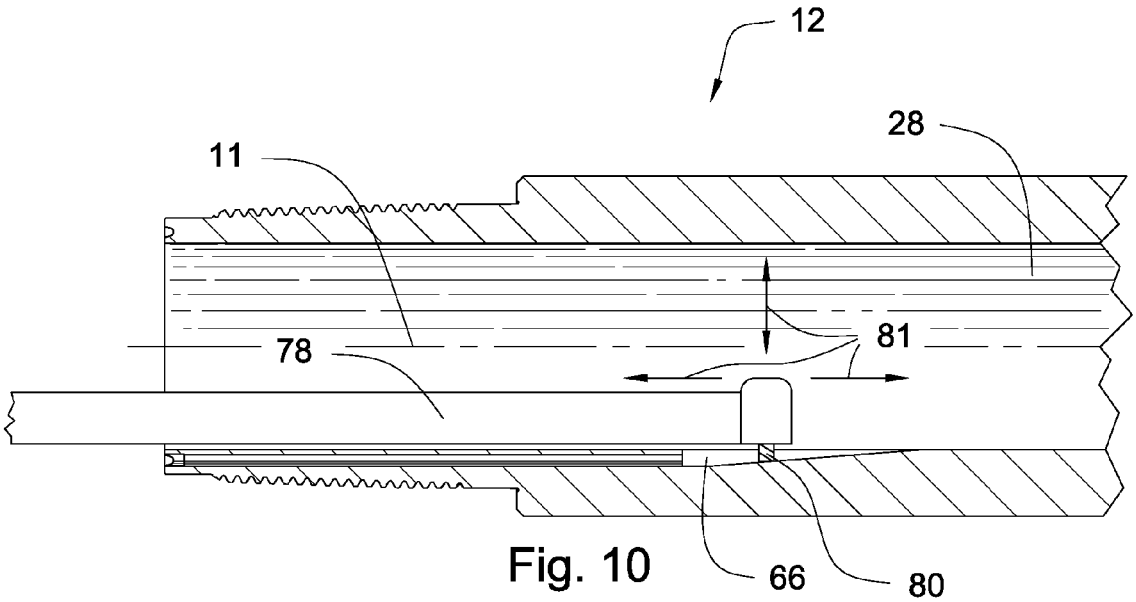
FIG. 10 is a cross-sectional view illustrating one embodiment of a tool used for milling channels into the inside wall of the central bore.

Referring to FIG. 10, a milling tool 78, as was previously mentioned with respect to FIGS. 8A, 8B, 9A, and 9B, may be inserted into the central bore 28 of a downhole tool 12. The milling tool 78 may include a milling bit 80 that may be used to mill the open channel 66 into the wall of the central bore 28. To form the open channel 66, the milling tool may be moved in various directions 81 as needed, and may or may not be computer controlled to provide accurate movement.

Figure 11:
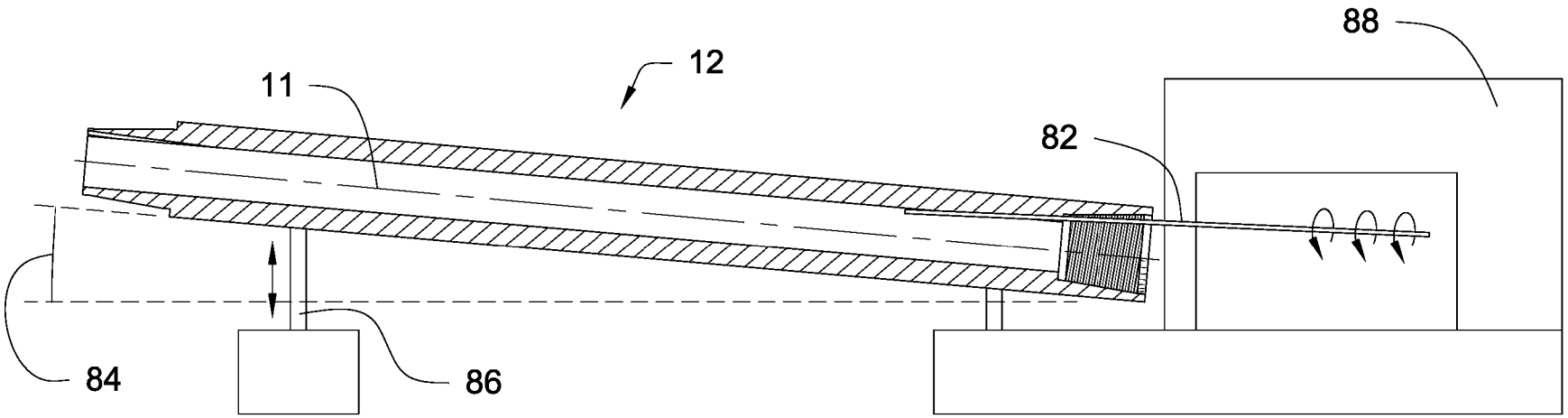
FIG. 11 is a cross-sectional view illustrating one embodiment of an apparatus and method for drilling channels into the downhole tool, wherein the channels are drilled at a positive, nominal angle with respect to the longitudinal axis of the downhole tool.

Referring to FIG. 11, as was previously mentioned with respect to FIGS. 9A and 9B, the channels 32, 34 may be drilled at an angle 86 with respect to the longitudinal axis 11 of the tool 12. Since drilling machinery 88, such as machinery 88 used for gun-drilling, may be large and complex, the drill tool 12 may be tilted at a desired angle 84 with respect to the drilling machine 88. In selected embodiments, an adjustable arm 86 may be used to support one end of the drill tool 12. The height of the adjustable arm 86 may be adjusted as needed to adjust the angle 84 of the drill tool with respect to the drill bit 82.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

The invention claimed is:

1. A method for routing a transmission line through a wall of a tool joint having a primary and secondary shoulder, a central bore, and a longitudinal axis, the method comprising:

forming a first channel at a nominal angle, that is positive with respect to the longitudinal axis, through the wall of the tool joint from the secondary shoulder to a point proximate an inside wall of the central bore; and forming a second channel, from the inside wall within the central bore, the second channel effective to merge with the first channel, thereby forming a continuous channel from the secondary shoulder to the central bore.

2. The method of claim 1, wherein the first channel is formed by gun-drilling.

3. The method of claim 1, further comprising tilting the tool joint before forming the first channel to produce the angle.

4. The method of claim 3, further comprising adjusting the tilt before forming the first channel to provide a desired positive angle.

5. The method of claim 1, wherein the nominal angle is greater than or equal to about 0.25 degrees.

6. The method of claim 1, wherein the first channel does not break into the central bore.

7. The method of claim 1, wherein the first channel breaks into the central bore at a non-perpendicular angle.

8. The method of claim 7, wherein a backing member is inserted into the central bore to facilitate a break through of the first channel into the central bore.

9. The method of claim 1, wherein the second channel is formed with a milling tool inserted into the central bore.

10. The method of claim 1, wherein the nominal angle is between about 0.25 degrees and about 15 degrees.

11. An apparatus comprising:

a tool joint for use with a downhole tool, the tool joint comprising a primary and a more internal secondary shoulder, a central bore, and a longitudinal axis;

a gun-drilled channel formed in the tool joint from the secondary shoulder to a point proximate the central bore; and an open channel milled from the central bore to the gun-drilled channel, such that the gun-drilled channel and the open channel merge to form a continuous channel;

wherein the gun-drilled channel is drilled at a nominal positive angle with respect to the longitudinal axis.

12. The apparatus of claim 11, wherein the nominal positive angle is greater than about 0.25 degrees and less than or equal to about 15 degrees.

13. The apparatus of claim 11, wherein the gun-drilled channel does not break into the central bore.

14. The apparatus of claim 11, wherein the gun-drilled channel breaks into the central bore at a non-perpendicular angle.

15. The apparatus of claim 11, wherein the gun-drilled channel breaks into the central bore substantially perpendicularly.

16. The apparatus of claim 11, wherein the open channel is milled with a milling tool inserted into the central bore.

17. A method for routing a transmission line through a tool joint of a downhole tool, wherein the tool joint includes a primary and a more internal secondary shoulders, a tool wall, a central bore, and a longitudinal axis, the method comprising:

increasing the inside diameter of a portion of the central bore to provide a first portion having a standard diameter, and a second portion having an enlarged diameter; and drilling a channel at a nominal positive angle with respect to the longitudinal axis through the tool wall from the secondary shoulder to an exit point within the second portion.

18. The method of claim 17, wherein drilling further comprises gun-drilling.

19. The method of claim 18, wherein gun-drilling does not break into the central bore.

20. The method of claim 19, wherein drilling further comprises milling back from the central bore to the gun-drilled channel.

21. The method of claim 20, wherein milling back opens up the channel to the central bore.

22. The method of claim 17, wherein the channel breaks into the central bore at a non-perpendicular angle.

23. The method of claim 22, wherein a backing member is inserted into the central bore to facilitate drilling into the central bore at a non-perpendicular angle.

24. The method of claim 17, wherein the channel breaks into the central bore at a substantially perpendicular angle.

25. A method for routing a transmission line through a downhole tool having primary and secondary shoulders, a central bore, and a longitudinal axis, the method comprising:

drilling a straight channel through the downhole tool at a positive nominal angle with respect to the longitudinal axis from the secondary shoulder to a point proximate the inside wall of the central bore; and milling back, from within the central bore, a second channel effective to merge with the straight channel, to form a continuous channel from the secondary shoulder to the central bore.

26. The method of claim 25, wherein the straight channel is formed by gun-drilling.

27. The method of claim 25, further comprising tilting the tool joint before forming the straight channel to produce the angle.

28. The method of claim 27, further comprising adjusting the tilt before forming the straight channel to provide a desired positive angle.

29. The method of claim 25, wherein the nominal angle is greater than or equal to about 0.25 degrees.

30. The method of claim 25, wherein the straight channel does not break into the central bore.

31. The method of claim 25, wherein the straight channel breaks into the central bore at a non-perpendicular angle.

32. The method of claim 32, wherein a backing member is inserted into the central bore to facilitate drilling the straight channel as it breaks out into the central bore.

33. The method of claim 25, wherein the second channel is formed with a milling tool inserted into the central here.

34. The method of claim 25, wherein the nominal angle is between about 0.25 degrees and about 15 degrees.

* * * * *